US006390838B1

(12) United States Patent
Kawamura

(10) Patent No.: US 6,390,838 B1
(45) Date of Patent: May 21, 2002

(54) ROTARY CONNECTOR FOR EFFECTING ELECTRICAL CONNECTION BETWEEN ELECTRIC DEVICES PROVIDED IN STEERING WHEEL AND VEHICLE BODY

(75) Inventor: Kazuya Kawamura, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/550,755

(22) Filed: Apr. 17, 2000

(30) Foreign Application Priority Data

Apr. 23, 1999 (JP) ..... 11-116124

(51) Int. Cl.[7] ..... H01R 35/04
(52) U.S. Cl. ..... 439/164
(58) Field of Search ..... 439/164, 15

(56) References Cited

U.S. PATENT DOCUMENTS 5,382,172 A * 1/1995 Klier et al. ..... 439/164
5,651,686 A 7/1997 Okuhara et al. ..... 439/164
5,655,919 A * 8/1997 Ishikawa et al. ..... 439/15
5,766,028 A * 6/1998 Ichikawa et al. ..... 439/164
6,217,355 B1 * 4/2001 Charnock ..... 439/164
6,299,453 B2 * 10/2001 Matsumoto ..... 439/164

* cited by examiner

*Primary Examiner*—Gary Paumen
(74) *Attorney, Agent, or Firm*—Brinks Hofer Gilson & Lione

(57) ABSTRACT

A rotary connector includes a movable member housing consisting of a lead block 6 having a lock portion 6*h*, an upper rotor member 1 having an accommodating portion 1*g* accommodating the lead block and a plurality of engagement portions 1*q*, and a lower rotor member 2 inserted into the upper rotor member and having a plurality of holding portions 2*f* to be engaged with the lock portion and the engagement portions, and a stationary member housing supporting the movable member housing, wherein the lower rotor member is inserted into the upper rotor member in which the lead block is accommodated to cause the holding portions to be engaged with the lock portion and the engagement portions.

8 Claims, 13 Drawing Sheets

ROTARY CONNECTOR FOR EFFECTING ELECTRICAL CONNECTION BETWEEN ELECTRIC DEVICES PROVIDED IN STEERING WHEEL AND VEHICLE BODY

BACKGROUND OF THE INVENTION

1. Field of the Invention

The present invention relates to a rotary connector attached to a steering shaft of an automobile or the like and adapted to effect electrical connection between electric devices provided in a steering wheel and a vehicle body.

2. Description of the Related Art

Hitherto, a rotary connector has been proposed which electrically connects an electric device provided in a steering wheel with an electric device provided in a vehicle body.

A rotary connector, which makes it possible to establish electrical connection between an electric device provided in a steering wheel, which is a rotary member, and an electric device provided in a vehicle body, which is a stationary member, accommodates a flexible electric cable or an optical fiber (which will be hereinafter generally referred to as "flexible cable") wound between a rotor portion rotated by the steering wheel and a case constituting a stator portion, one end of the cable being fastened to the rotor portion, the other end thereof being fastened to the stator portion, electrical connection between the electric devices being made possible by utilizing winding and rewinding of the flexible cable.

A conventional rotary connector will be described with reference to drawings.

FIG. 8 is an exploded perspective view of a conventional rotary connector; FIG. 9 is a sectional view of the conventional rotary connector; FIG. 10 is an enlarged sectional view of portion A of FIG. 9; FIG. 11 is a perspective view of an upper rotor portion and a lead block in the conventional rotary connector; FIG. 12 is a perspective view of the lead block of the conventional rotary connector; and FIG. 13 is a perspective view of a lower rotor portion of the conventional rotary connector.

First, as shown in FIGS. 8 and 9, this rotary connector 100 generally comprises an upper rotor member 11, a lower rotor member 12, a cable accommodating portion 13 and a lower cover 14, which are connected concentrically and rotatably, and a flexible cable 15 accommodated and wound in the space between the upper and lower rotor members 11 and 12 and the cable accommodating portion 13 and the lower cover 14, both ends of the flexible cable 15 being electrically led out indirectly to the exterior of the cable accommodating portion 13, etc. through an inner lead block 16 and an outer lead block 17. The inner lead block 16 is locked to the outer edge portion of the upper rotor member 11, and the outer lead block 17 is locked to the outer edge portion of the lower cover 14.

And, the upper rotor member 11 and the lower rotor member 12 are combined to form an integral unit serving as a movable member housing, and the cable accommodating portion 13 and the lower cover 14 are combined to form an integral unit serving as a stationary member housing. When the movable member housing is rotated clockwise or counterclockwise, the flexible cable 15 is wound or rewound in the space.

In this rotary connector 100, the upper and lower rotor members 11 and 12 forming the movable member housing and the cable accommodating portion 13 and the lower cover 14 forming the stationary member housing are engaged with each other relatively loosely, and a relatively large clearance is formed in the engagement portion. Due to the play between the movable member housing and the stator member housing owing to the clearance in this engagement portion, the stability in the rotation of the rotary connector 100 is maintained.

In this rotary connector 100, generally constructed as described above, the stationary member housing consisting of the cable accommodating portion 13 and the lower cover 14 is secured to a vehicle body (not shown), and the movable member housing consisting of the upper rotor member 11 and the lower rotor member 12 is secured to a hub (not shown) of a steering shaft. Further, both ends of the flexible cable 15 are connected to electric devices provided in the vehicle body and the steering wheel through connectors 18 and 19, whereby the rotary connector is used as an electrical connection means for a motor-vehicle-mounted air back system, a horn circuit, etc.

Next, the upper rotor member 11 and the inner lead block 16 of the conventional rotary connector 100 will be described.

As shown in FIG. 11, the upper rotor member 11 of the rotary connector 100 is formed of a synthetic resin material, molded, has a substantially ring-like configuration, and comprises a small diameter cylindrical portion 11*b* having a round center hole 11*a* at its center, an intermediate diameter cylindrical portion 11*c* outwardly (upwardly) connected to the small diameter cylindrical portion 11*b*, a large diameter cylindrical portion 11*d* outwardly (upwardly) connected to the intermediate diameter cylindrical portion 11*c*, and a circular flange portion 11*e* outwardly protruding from the upper end portion of the large diameter cylindrical portion 11*d*.

Further, at a predetermined position of a flat portion 11*f* between the intermediate diameter cylindrical portion 11*c* and the large diameter cylindrical portion 11*d*, there is provided a substantially box-shaped accommodating portion 11*g* which protrudes outwardly (upwardly), and a substantially rectangular opening 11*n* is provided in a part of an upper surface 11*p* of this accommodating portion 11*g*. To achieve a uniform balance in weight in order that the upper rotor member 11 may rotate in a stable manner, this accommodating portion 11*g* is thin-walled and light in weight. Further, on the inner wall of the small diameter cylindrical portion 11*b*, there are provided a plurality of (e.g., four) engagement portions 11*h* which are substantially triangular-pyramid-shaped, a plurality of (e.g., two) prism-shaped protrusions which are parallel with the axis, and a substantially rectangular recess 11*j*.

The upper surface 11*k* of each engagement portion 11*h* (See FIG. 10) is formed as a plane orthogonal to the axis of the movable member housing, and the lower surface 11*m* there is inclined so as to make a predetermined angle with respect to the axis.

As shown in FIG. 12, the inner lead block 16 of the rotary connector 100 is formed of a synthetic resin material, shaped, and comprises a joint base 16*a* having a substantially U-shaped section, a joint cover 16*b* arranged so as to close the open surface of the joint base 16*a*, and a substantially flat joint bar 16*c* which is arranged between the joint base 16*a* and the joint cover 16*b*. Further, connected to both ends of the joint bar 16*c* are a plurality of (e.g., four) lead lines 20 and the joint cable 15 (See FIG. 8), electrical conduction being established between each lead line 20 and the flexible cable (See FIG. 8).

The lead lines 20 are led out to the exterior from one end surface of the inner lead block 16.

The joint cover 16*b* comprises a cover portion 16*d* closing the open surface of the joint base 16*a*, a box portion 16*e* outwardly protruding from the cover portion 16*d*, and a pair of flanges 16*f* provided in the middle section of the opposed side walls of the box portion 16*e*. Further, a partition 16*g* is provided in the interior of the box portion 16*e*, the upper surface of the partition 16*g* being flush with the upper surface of the box portion 16*e*.

The joint base 16*a* and the joint cover 16*b* are joined together by an appropriate means such as snap-in engagement to form an integral unit, with the joint bars 16*c* being accommodated therein.

The inner lead block 16 is accommodated in the accommodating portion 11*g* of the upper rotor member 11. In this state, the lead lines 20 of the inner lead block 16 are led out to the exterior from the opening 11*n*, and a part of the upper end surface of the inner lead block 16 is in contact with the upper wall 11*p* of the accommodating portion 11*g*.

The upper surface of the partition 16*g* and the upper surface of the box portion 16*e* are substantially flush with the inner wall surface of the small diameter cylindrical portion.

Next, the lower rotor member 12 of the conventional rotary connector 100 will be described.

As shown in FIG. 13, the lower rotor member 12 is formed of a synthetic resin material, molded, of a substantially ring-like configuration, and comprises a first cylindrical portion 12*b* having a circular center hole 12*a* at its center, a second cylindrical portion 12*c* outwardly (downwardly) connected to the first cylindrical portion 12*b*, and a circular flange 12*d* outwardly protruding from the upper end portion of the second cylindrical portion 12*c*.

Further, the first cylindrical portion 12*b* is provided with a pair of grooves 12*e* opposed to each other, and a plurality of (e.g., five) rectangular openings 12*f*. The upper inner wall 12*g* of each of the plurality of openings 12*f* (See FIG. 10) is formed as a plane orthogonal to the axis of the movable member housing. At the open end of the first cylindrical portion 12*b*, there is formed a substantially annular inclined surface 12*h* having a predetermined inclination angle.

The first cylindrical portion 12*b* of the lower rotor member 12 is inserted into the small diameter cylindrical portion 11*b* of the upper rotor member 11. At this time, the inner upper wall 12*g* of each hole 12*f* is in contact with the upper surface 11*k* of each engagement portion 11*h*, and the protrusions 11*i* are arranged in the grooves 12*e*. In this way, the upper rotor member 11 and the lower rotor member 12 are engaged with each other.

In the movable member housing (composed of the upper rotor member 11, the lower rotor member 12 and the inner lead block 16) of the rotary connector 100, constructed as described above, however, the inner lead block 16 is accommodated in the accommodating portion 11*g* of the upper In rotor member 11. Thus, if a strong outward tensile force (in the direction of the arrow B: See FIG. 11) is applied to the lead lines 20 of the inner lead block 16 or the inner lead block 16 itself, the accommodating portion 11*g* is pulled in the direction of the arrow B by this tensile force through the inner lead block 16.

And, when the accommodating portion 11*g* is pulled, this tensile force is applied to the upper surface 11*p* of the accommodating portion 11*g*. To achieve balance in weight of the upper rotor member 11, the upper surface 11*p* is thin-walled and light in weight, which means it does not have a sufficient strength. Thus, by the force strongly pulling the lead lines 20 or the force upwardly pulling the inner lead block 16, the upper surface 11*p* is damaged, and the inner lead block 16 is detached from the accommodating portion 11*g* and gets out of it. Thus, it is not strong enough to withstand decomposition.

SUMMARY OF THE INVENTION

The present invention has been made with a view toward solving the above problem in the prior art. It is accordingly an object of the present invention to provide a rotary connector in which the inner lead block 16, accommodated in the accommodating portion 11*g* of the upper rotor member 11, is reliably kept accommodated in the accommodating portion 11*g* even if a strong tensile force is applied to the inner lead block 16 and which is strong enough to withstand decomposition.

In accordance with the present invention, there is provided a rotary connector comprising a movable member housing consisting of a lead block having a lock portion, an upper rotor member having an accommodating portion accommodating the lead block and a plurality of engagement portions, and a lower rotor member inserted into the upper rotor member and having a plurality of holding portions to be engaged with the lock portion and the engagement portions, and a stationary member housing supporting the movable member housing, wherein the lower rotor member is inserted into the upper rotor member in which the lead block is accommodated to cause the holding portions to be engaged with the lock portion and the engagement portions.

Further, in accordance with the present invention, there is provided a rotary connector comprising a movable member housing consisting of a lead block having a lock portion, an upper rotor member having an accommodating portion accommodating the lead block and a cylindrical portion equipped with a plurality of engagement portions, and a lower rotor member inserted into the cylindrical portion of the upper rotor member and having a plurality of holding portions to be engaged with the lock portion and the engagement portions, and a stationary member housing supporting the movable member housing, wherein the lead block is accommodated in the accommodating portion, the lock portion being arranged in the cylindrical portion, the lower rotor member being inserted into the cylindrical portion of the upper rotor member to cause the holding portions to be engaged with the lock portion and the engagement portions.

Further, in accordance with the present invention, there is provided a rotary connector wherein the engagement surface between the lock portion and the holding portions is formed so as to make an acute angle with respect to the inner wall of the cylindrical portion of the upper rotor member.

Further, in accordance with the present invention, there is provided a rotary connector wherein the holding portions are provided on the inner wall of a hole provided in the cylindrical portion of the lower rotor member.

DESCRIPTION OF THE PREFERRED EMBODIMENT

In the following, a rotary connector according to the present invention will be illustrated with reference to drawings.

Figure 1:
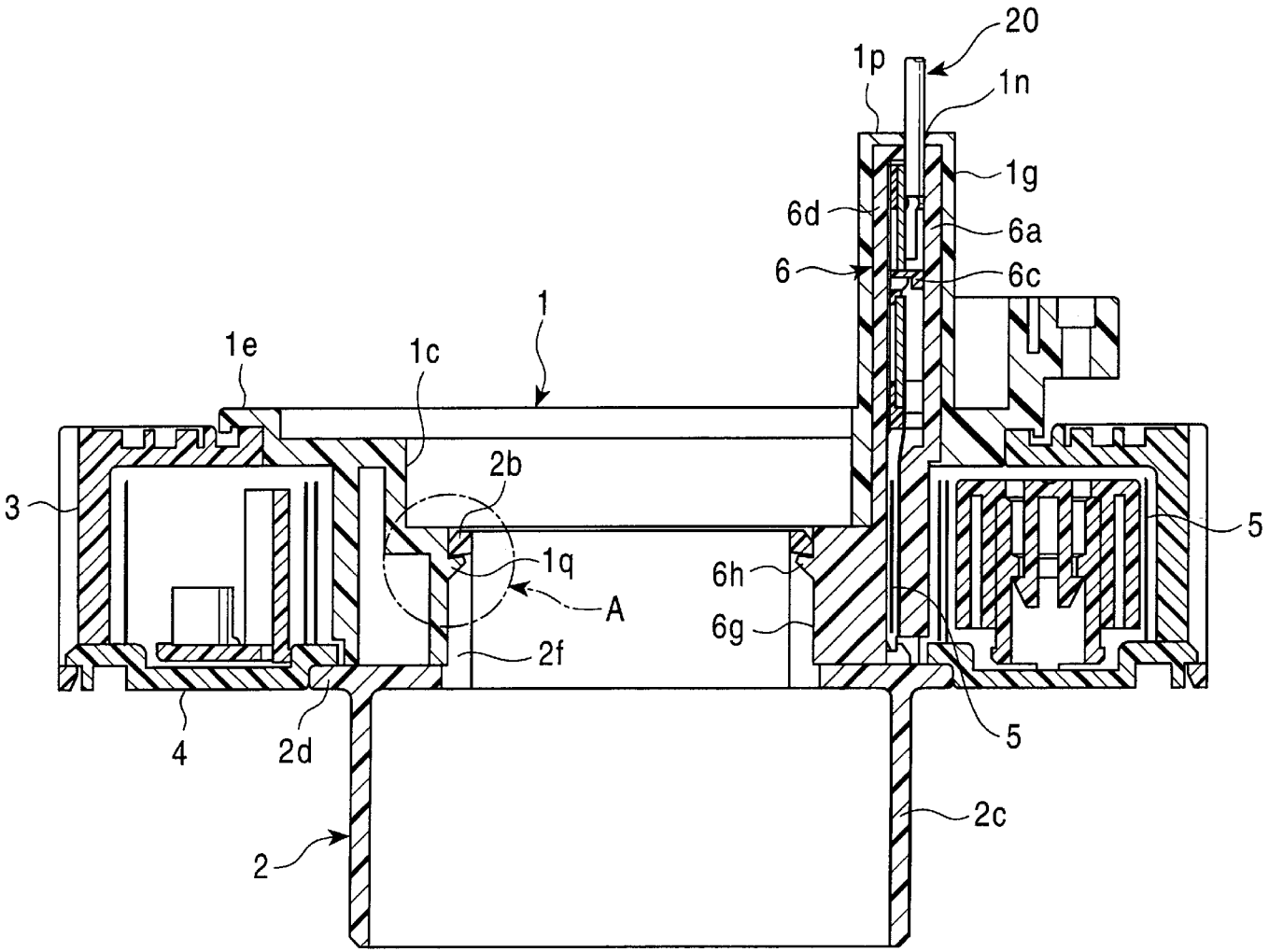
FIG. 1 is a sectional view of a rotary connector according to an embodiment of the present invention.
Figure 2:
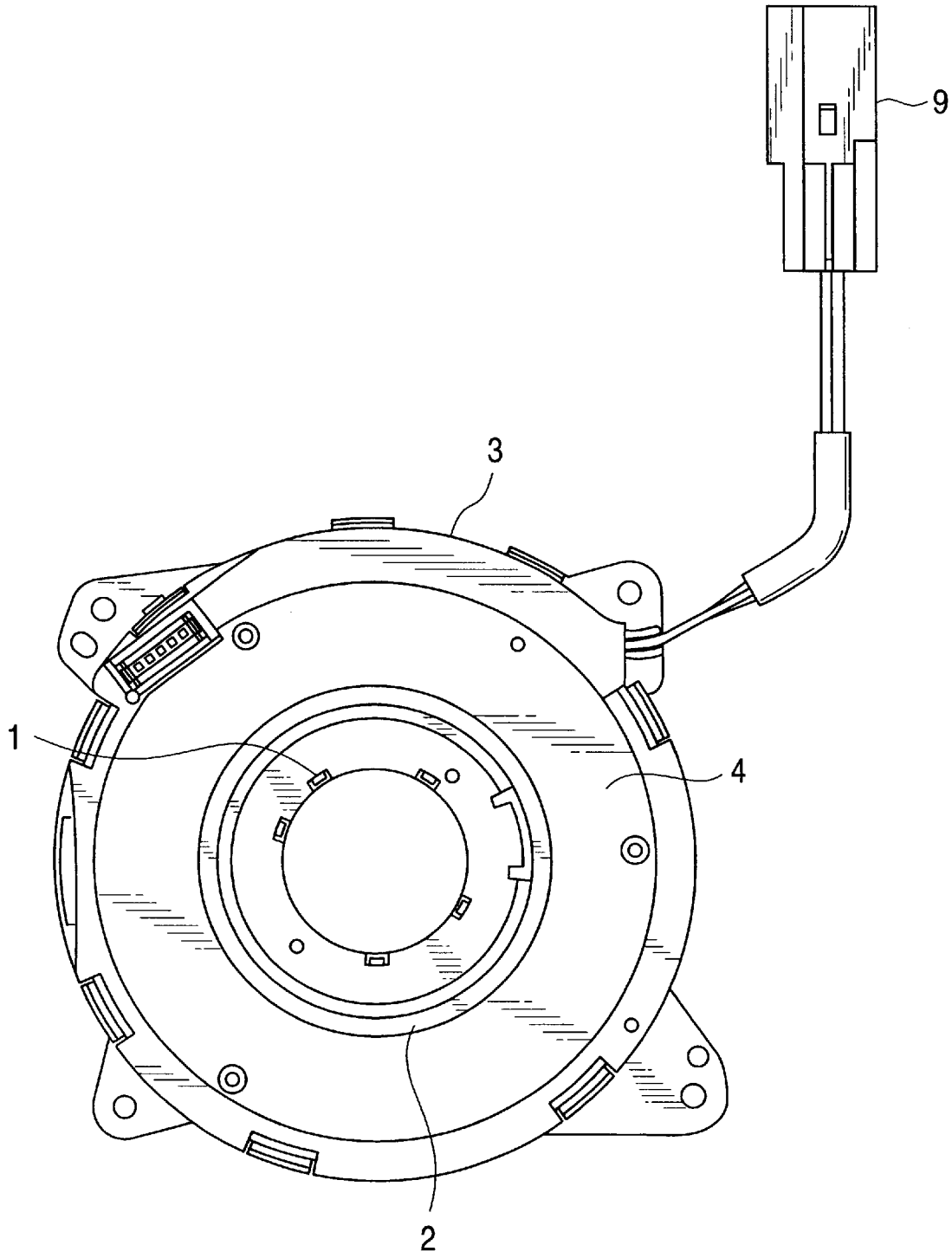
FIG. 2 is a bottom view of a rotary connector according to an embodiment of the present invention.
Figure 3:
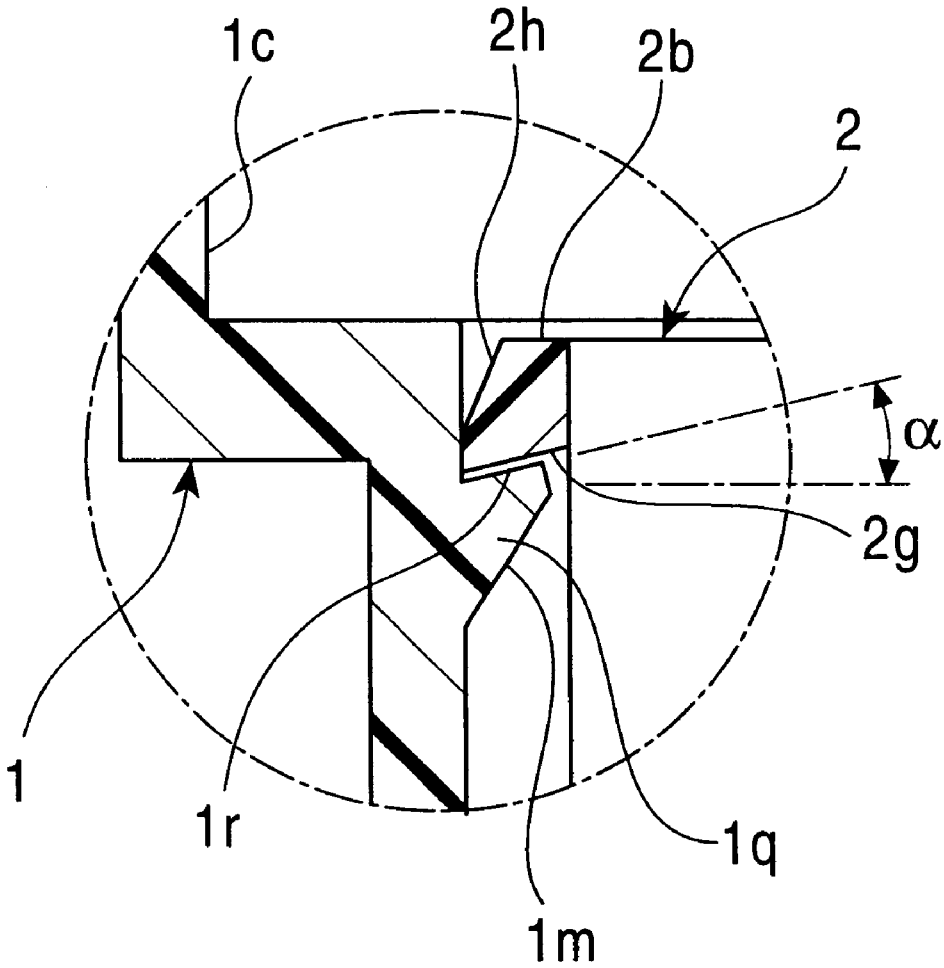
FIG. 3 is an enlarged sectional view of portion A of FIG. 1.
Figure 4:
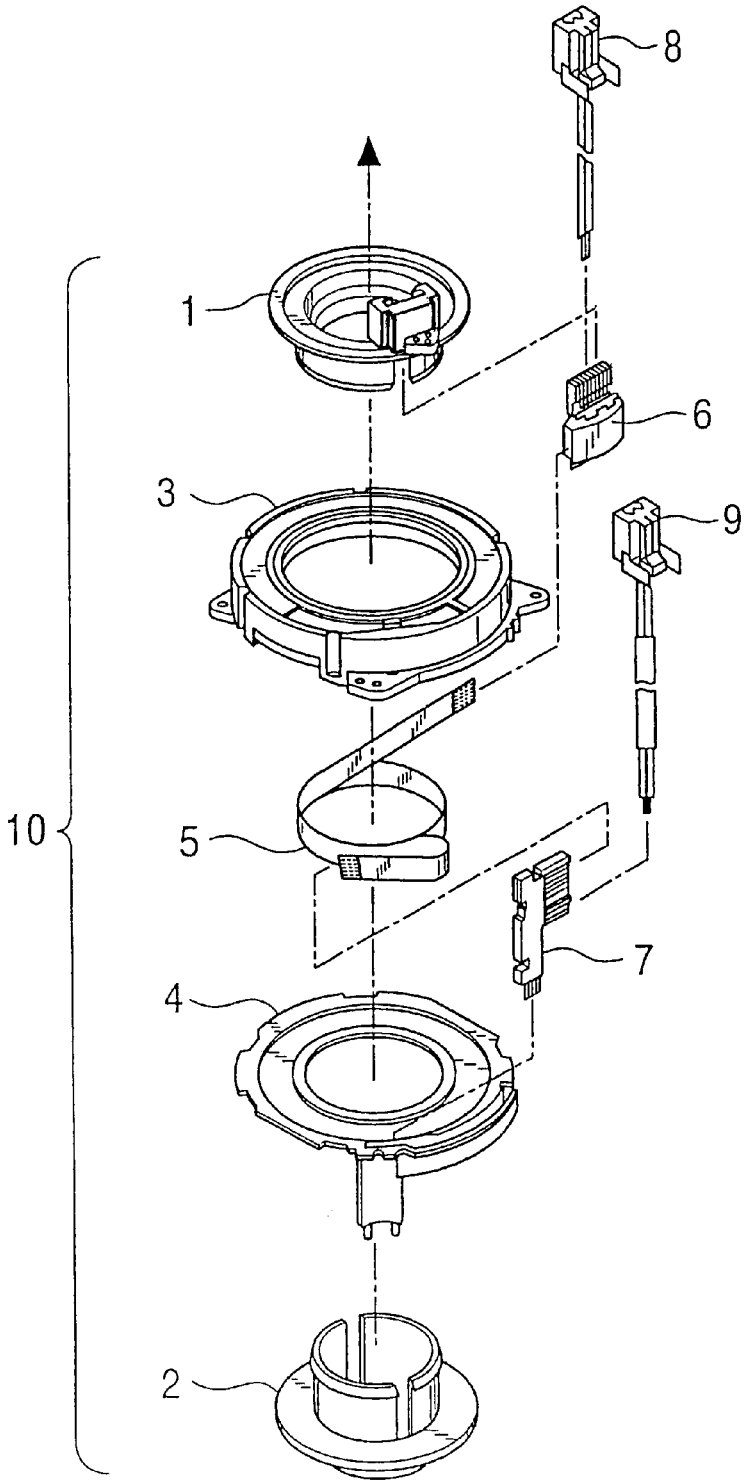
FIG. 4 is an exploded perspective view of a rotary connector according to an embodiment of the present invention.
Figure 5:
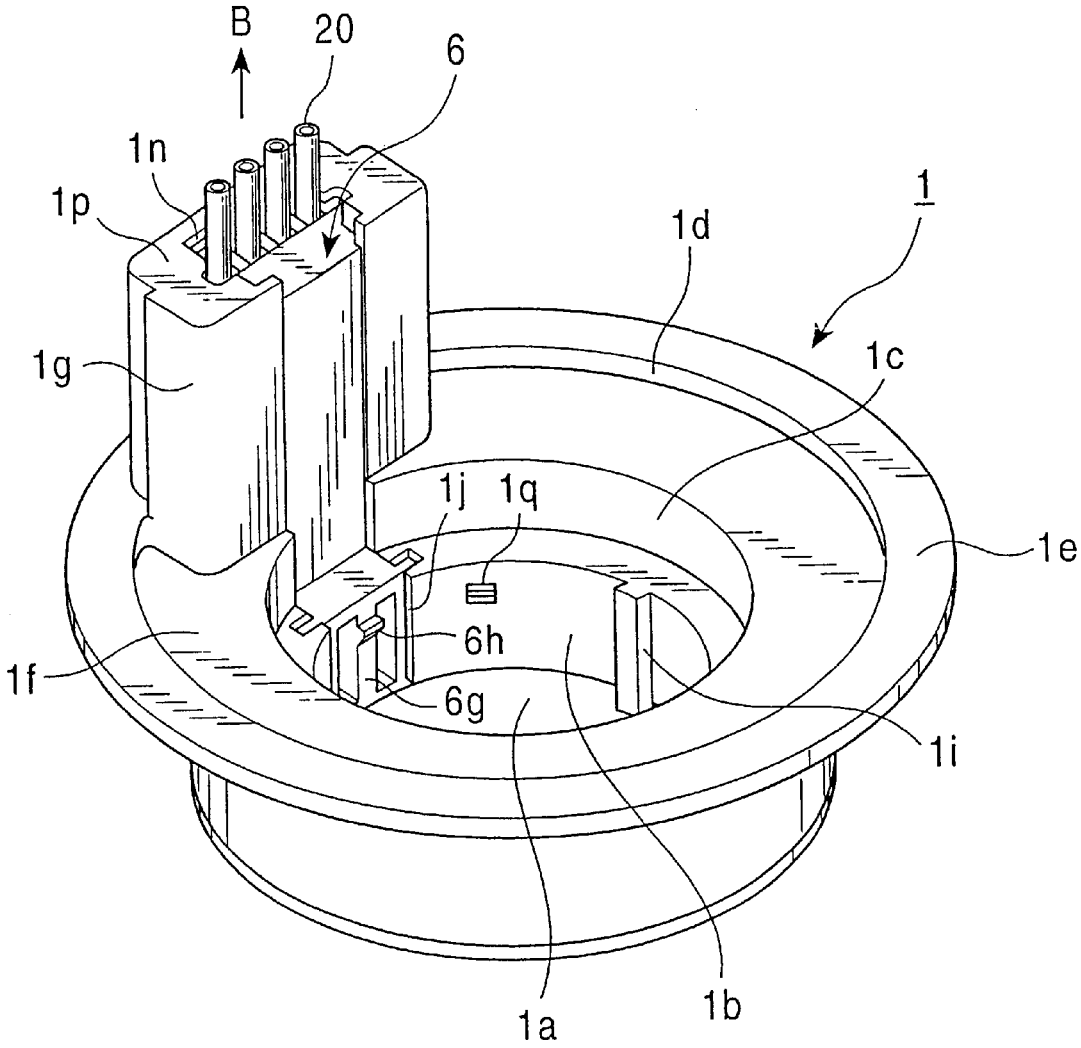
FIG. 5 is a perspective view of an upper rotor portion and a lead block of a rotary connector according to an embodiment of the present invention.
Figure 6:
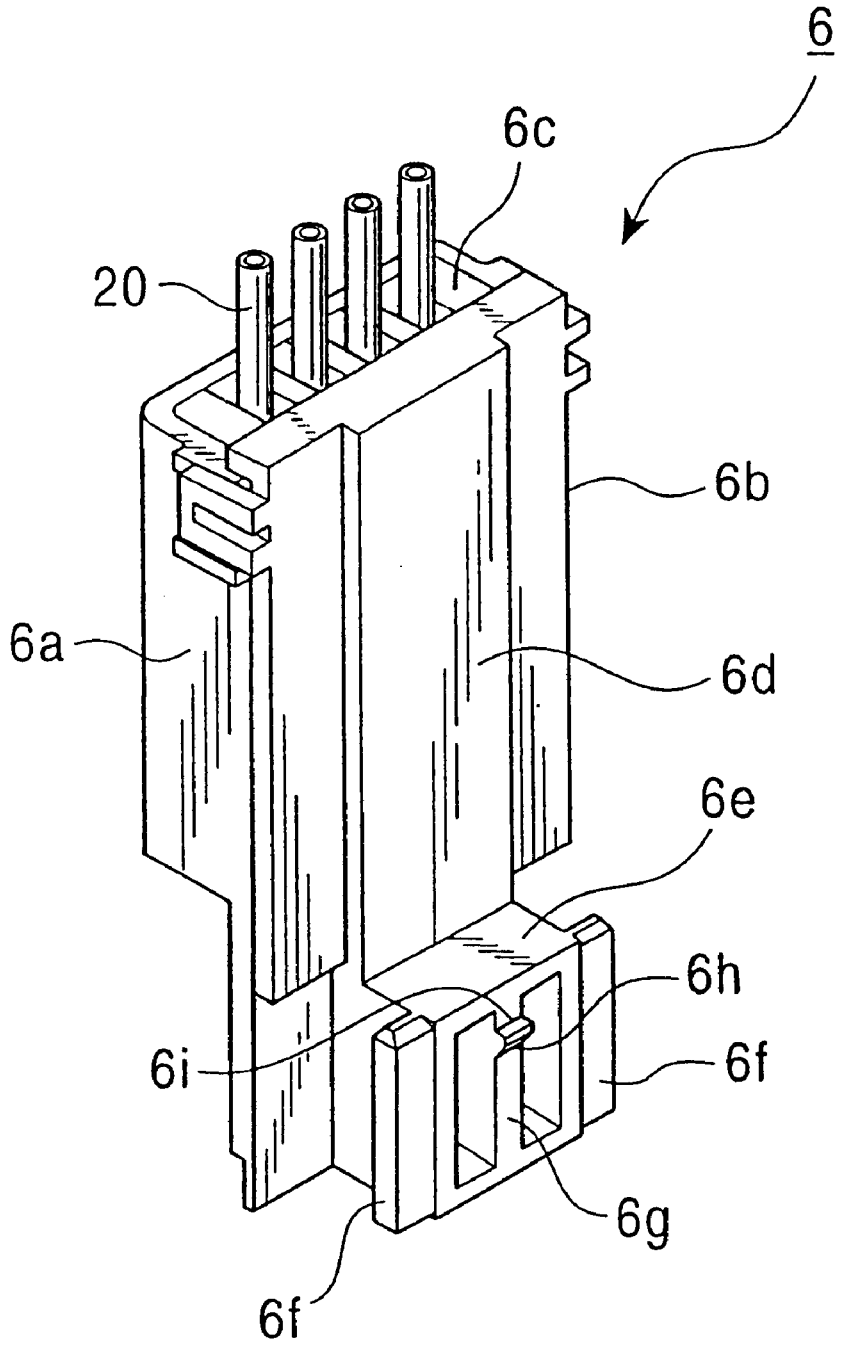
FIG. 6 is a perspective view of a lead block of a rotary connector according to an embodiment of the present invention.
Figure 7:
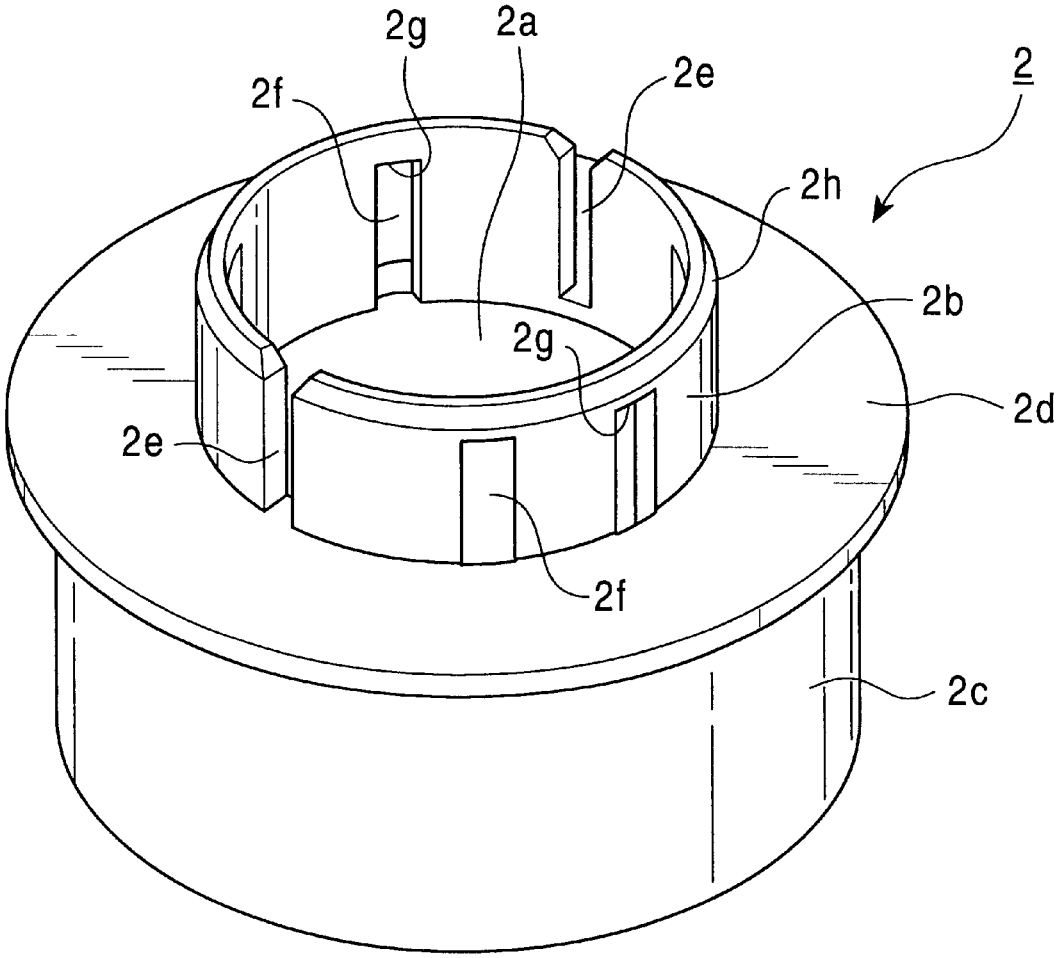
FIG. 7 is a perspective view of a lower rotor portion of a rotary connector according to an embodiment of the present invention.
Figure 8:
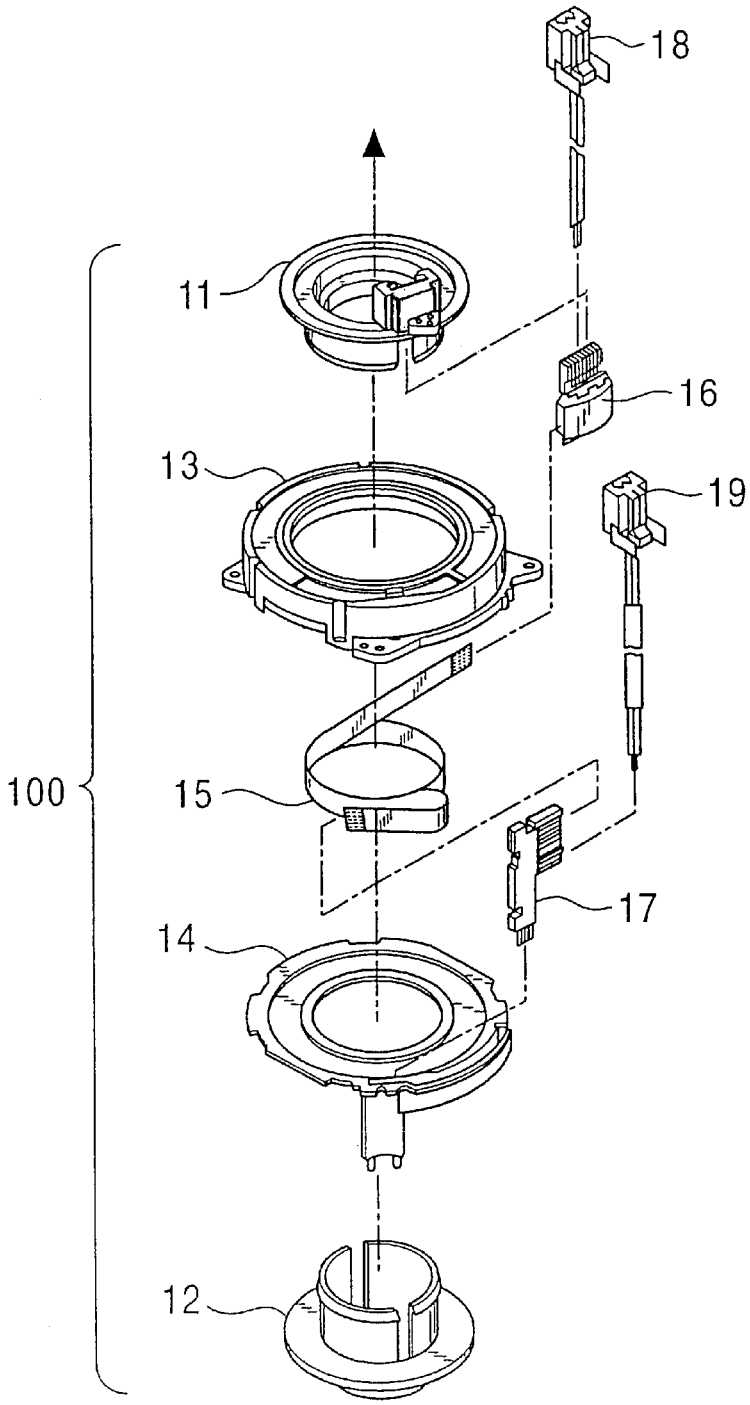
FIG. 8 PRIOR ART
FIG. 8 is an exploded perspective view of a conventional rotary connector.
Figure 9:
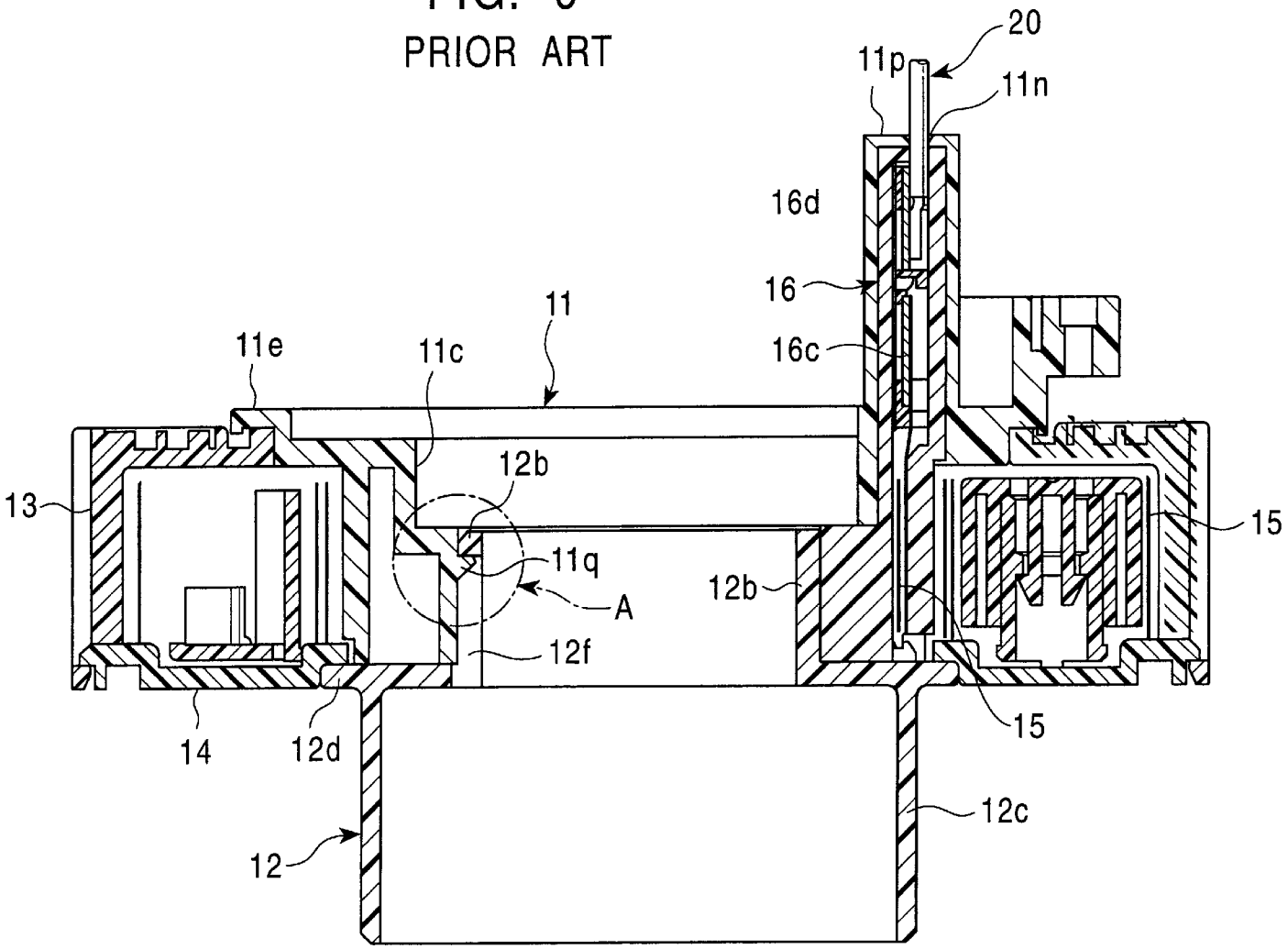
FIG. 9 PRIOR ART
FIG. 9 is a sectional view of a conventional rotary connector.
Figure 10:
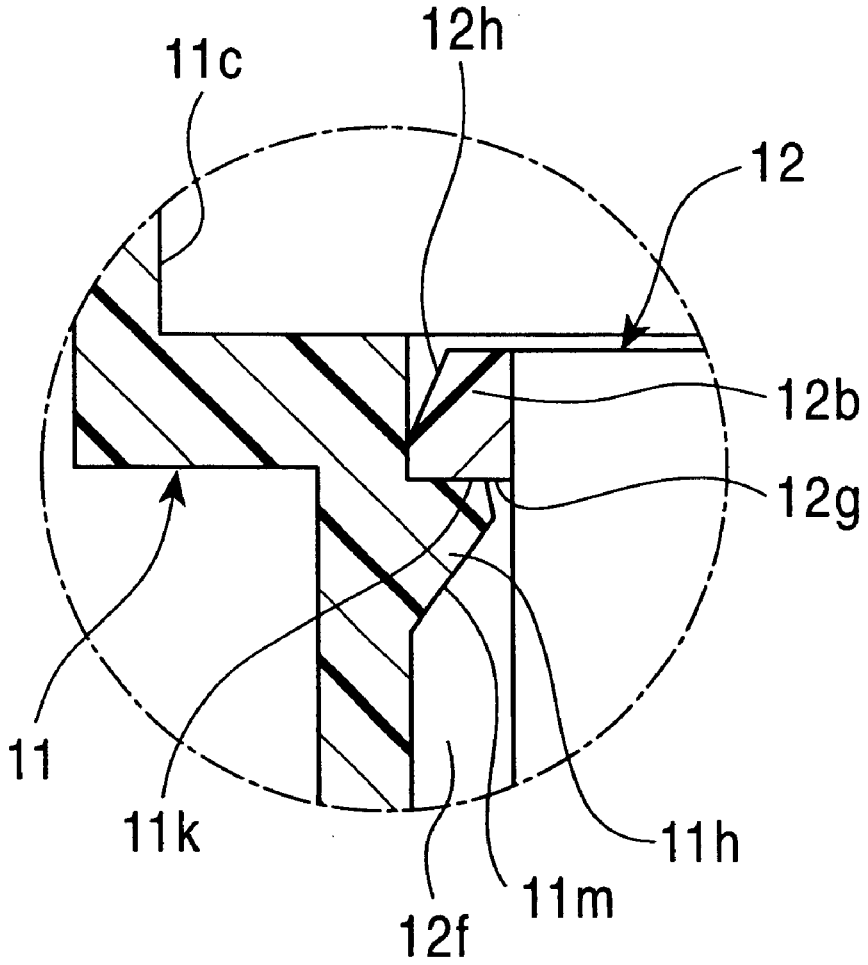
FIG. 10 PRIOR ART
FIG. 10 is an enlarged sectional view of portion A of FIG. 9.
Figure 11:
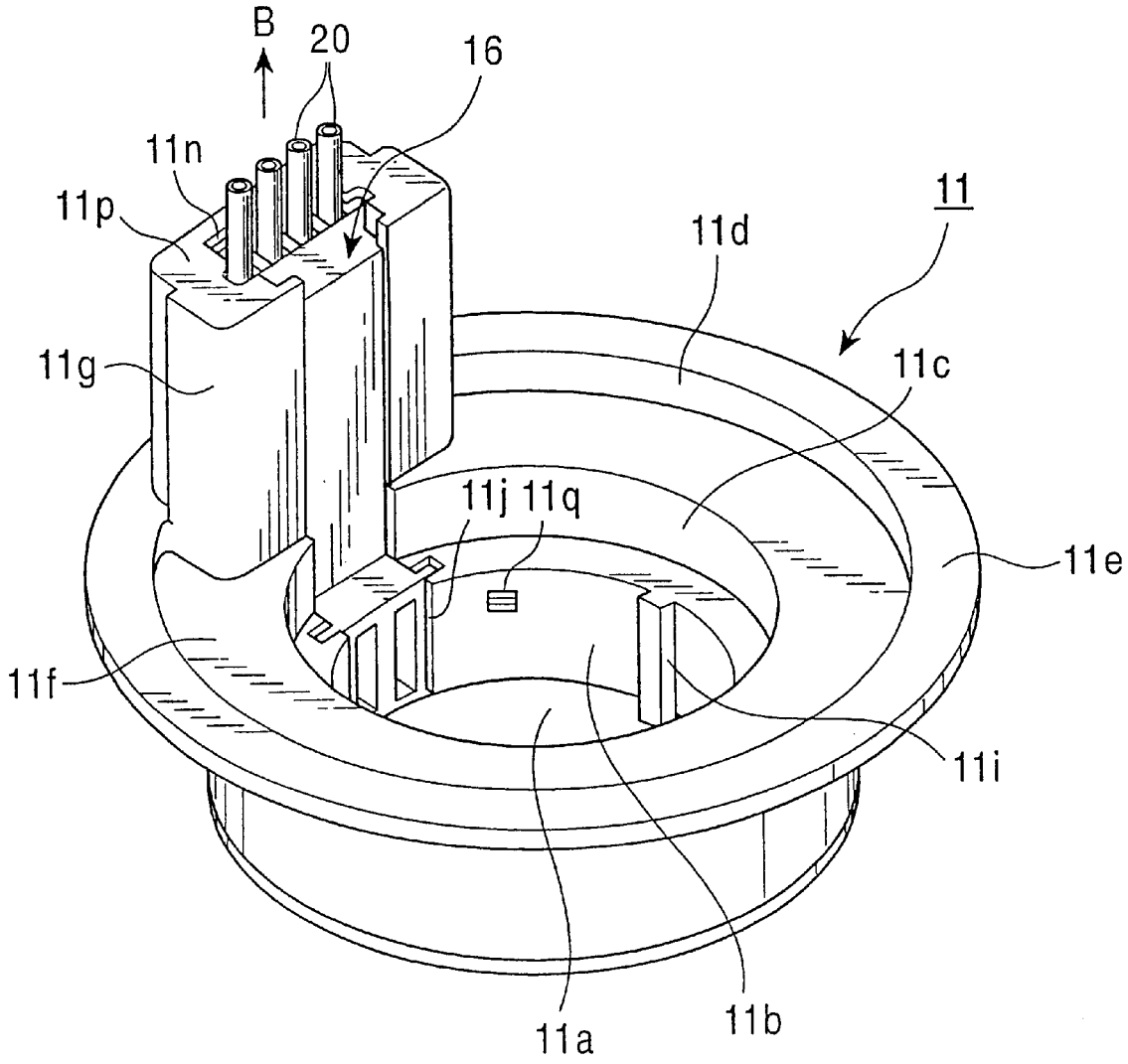
FIG. 11 PRIOR ART
FIG. 11 is a perspective view of an upper rotor portion and a lead block of a conventional rotary connector.
Figure 12:
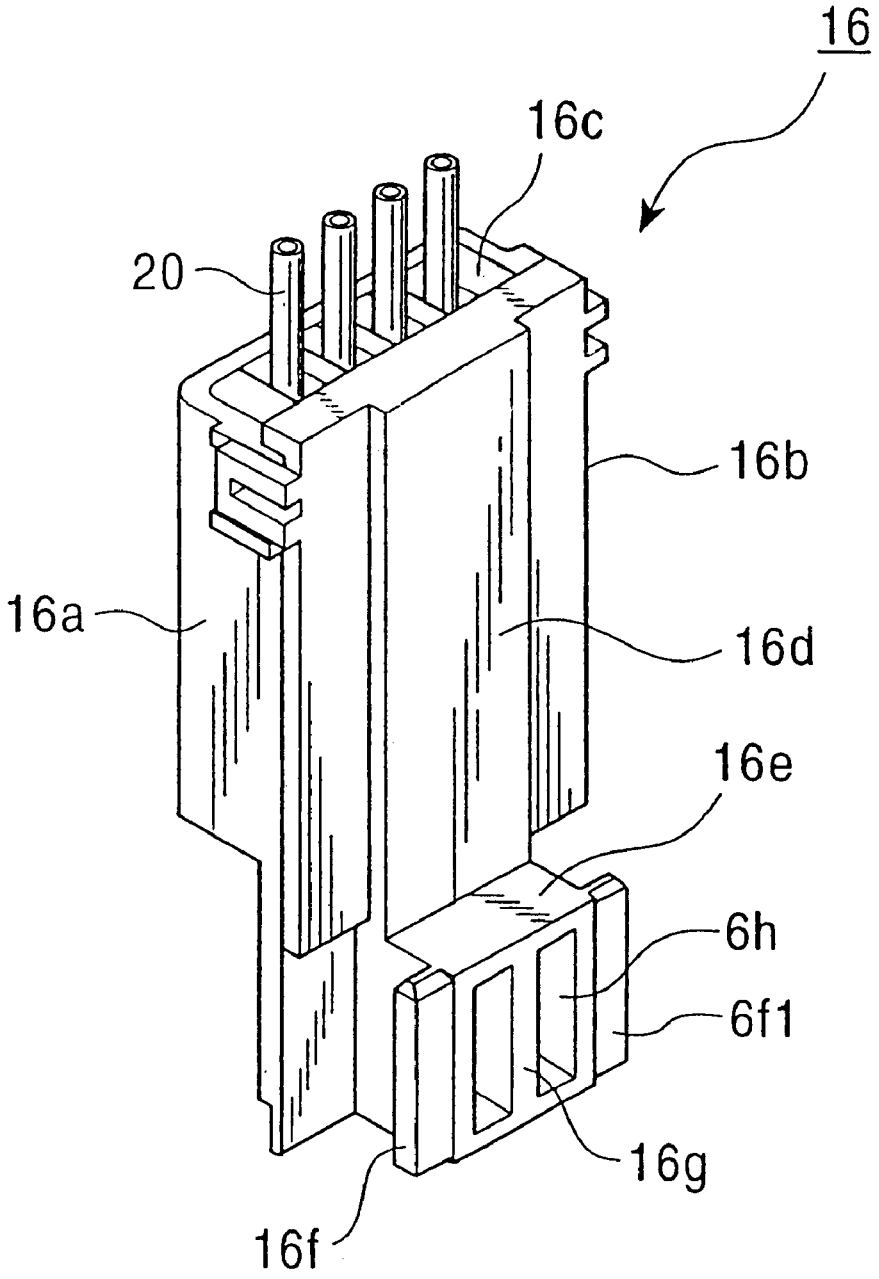
FIG. 12 PRIOR ART
FIG. 12 is a perspective view of a lead block of a conventional rotary connector.
Figure 13:
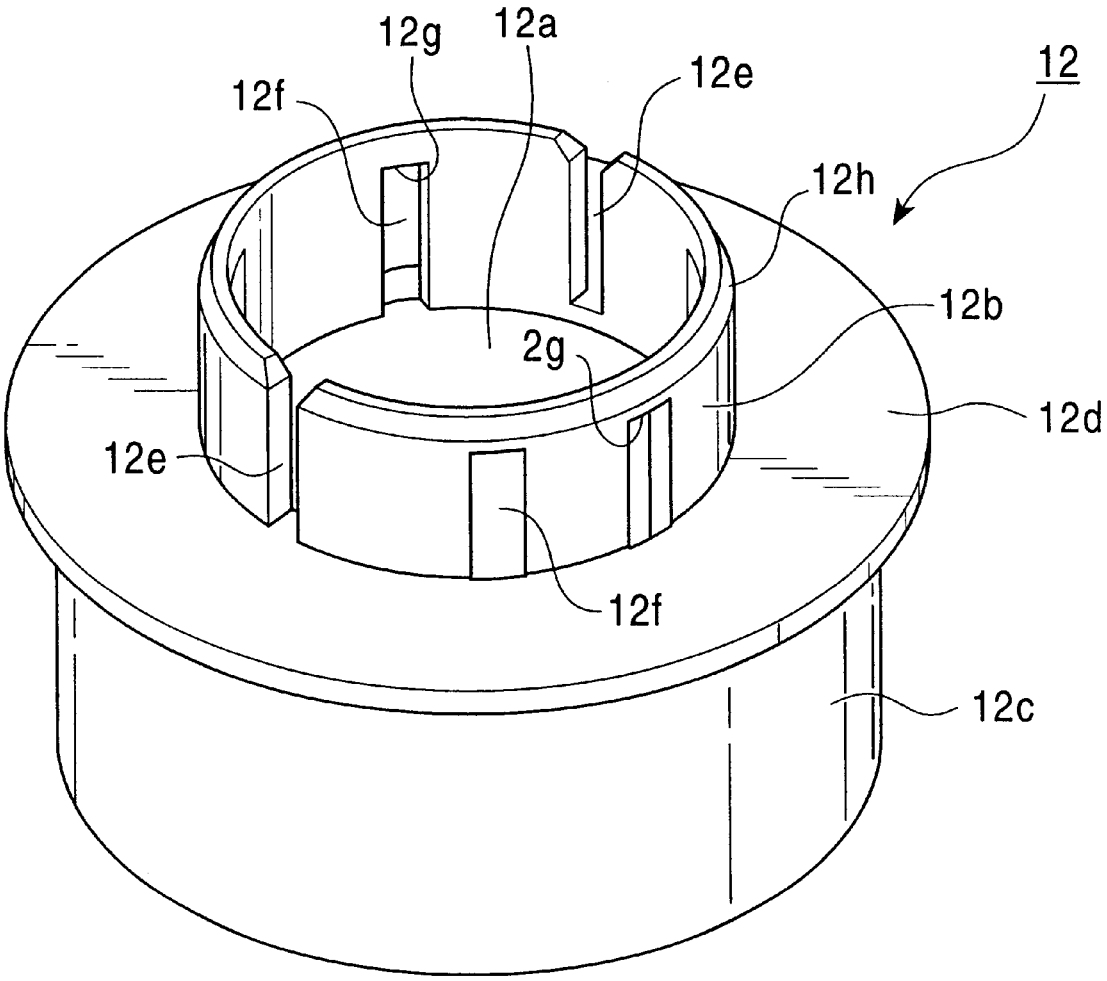
FIG. 13 PRIOR ART
FIG. 13 is a perspective view of a lower rotor portion of a conventional rotary connector.

FIG. 1 is a sectional view of a rotary connector according to an embodiment of the present invention; FIG. 2 is a bottom view of a rotary connector according to an embodiment of the present invention; FIG. 3 is an enlarged sectional view of portion A of FIG. 1; FIG. 4 is an exploded perspective view of a rotary connector according to an embodiment of the present invention; FIG. 5 is a perspective view of an upper rotor portion and a lead block of a rotary connector according to an embodiment of the present invention; FIG. 6 is a perspective view of the lead block of a rotary connector according to an embodiment of the present invention; and FIG. 7 is a perspective view of a lower rotor portion of a rotary connector according to an embodiment of the present invention.

First, as shown in FIG. 4, this rotary connector 10 generally comprises an upper rotor member 1 and a lower rotor member 2 which are connected concentrically and rotatably, a cable accommodating portion 3, a lower cover 4, and a flexible cable 5 accommodated and wound in the space defined between the upper and lower rotor members 1 and 2, the cable accommodating portion 3 and the lower cover 4, both ends of the flexible cable 5 being electrically led out indirectly through an inner lead block 6 and an outer lead block 7. The inner lead block 6 is locked to the outer edge portion of the upper rotor member 1, and the outer lead block 7 is locked to the outer edge portion of the lower cover 4.

And, the upper rotor member 1 and the lower rotor member 2 are combined into a movable member housing, and the cable accommodating portion 3 and the lower cover 4 are combined integrally to form a stationary member housing. When the movable member housing is rotated clockwise or counterclockwise, the flexible cable is wound or rewound in the space.

The upper and lower rotor members 1 and 2 forming the movable member housing and the cable accommodating portion 3 and the lower cover 4 forming the stationary member housing of the rotary connector 10 are engaged with each other relatively loosely, and a relatively large clearance is formed in the engagement portion. Due to the play between the movable member housing and the stationary member housing owing to the clearance in the engagement portion, the rotation of the rotary connector 10 is maintained.

In this rotary connector 10, generally constructed as described above, the stationary member housing consisting of the cable accommodating portion 3 and the lower cover 4 is secured to the vehicle body, and the movable member housing consisting of the upper rotor member 1 and the lower rotor member 2 is secured to the hub (not shown) of the steering shaft. Further, both ends of the flexible cable 5 are connected to the electric devices on the vehicle body side and the steering wheel side through connectors 8 and 9, whereby the rotary connector is used as electrical connection means for a motor-vehicle-mounted air back system, a horn circuit, etc.

Next, the upper rotor member 1 and the inner lead block 6 of the rotary connector 10 of the present invention will be described.

As shown in FIG. 5, the upper rotor member 1 of the rotary connector 10 is formed of a synthetic resin material, molded, and substantially of a ring-like configuration, and comprises a small diameter cylindrical portion 1*b* having a circular center hole 1*a* at its center, an intermediate diameter cylindrical portion 1*c* connected outwardly (upwardly) to the small diameter cylindrical portion 1*b*, a large diameter cylindrical portion 1*d* connected outwardly (upwardly) to the intermediate diameter cylindrical portion 1*c*, and a round flange 1*e* protruding from the upper end portion of the large diameter cylindrical portion 1*d*.

Further, at a predetermined position of a flat portion 1*f* between the intermediate diameter cylindrical portion 1*c* and the large diameter cylindrical portion 1*d*, there is provided a substantially box-shaped accommodating portion 1*g* protruding outwardly (upwardly), and a substantially rectangular opening 1*n* is provided in a part of the upper surface of the accommodating portion 1*g*. To achieve a uniform balance in weight in order that the upper rotor member 1 may rotate in a stable manner, the accommodating portion 1*g* is thin-walled and light in weight. Further, the inner wall of the small diameter cylindrical portion 1*b* has a plurality of (e.g., four) substantially triangular-pyramid-shaped engagement portions 1*q*, a plurality of (e.g., two) prism-shaped protrusions 1*i* which are parallel with the axis, and a substantially rectangular recess 1*j*.

And, for example, each of the upper surfaces 1*r* of approximately half the plurality of engagement portions 1*q* (e.g., two, every other or every third of them) (See FIG. 3) is formed as a surface inclined by a predetermined inclination angle $\alpha$ with respect to a plane orthogonal to the axis of the movable member housing, and each of the remaining (e.g., two) upper surfaces 1*r* is formed as a surface orthogonal to the axis. That is, the upper surface 1*r* of the engagement portion 1*q* (See FIG. 3) makes an acute angle with the inner wall of the small diameter cylindrical portion 1*b*.

Further, the lower surface 1*m* of each engagement portion 1*q* is inclined with respect to the axis by a predetermined angle (for example, an angle larger than the inclination angle $\alpha$).

Next, as shown in FIG. 6, the inner lead block 6 of the rotary connector 10 is formed of a synthetic resin material, and molded, and comprises a joint base 6*a* having a substantially U-shaped sectional configuration, a joint cover 6*b* arranged so as to close the open surface of the joint base 6*a*, and a substantially flat joint bar 6*c* arranged in the space between the joint base 6*a* and the joint cover 6*c*. Further, connected to the joint bar 6*c* are a plurality of (e.g., four) lead lines 20 and the flexible cable 5 (See FIG. 4), the lead lines 20 and the flexible cable 5 (See FIG. 4) being connected through a wiring pattern (not shown).

The lead lines 20 are led out to the exterior from one end surface of the inner lead block 6.

Further, the joint cover 6*b* comprises a cover 6*d* closing the open surface of the joint base 6*a*, a box-shaped portion 6*e* outwardly protruding from the cover 6*d*, and a pair of flanges 6*f* provided in the middle portion of the opposed side walls of the box-shaped portion 6*e*. Further, inside the box-shaped portion 6*e*, there is provided a partition 6*g*, which is provided with a substantially triangular-pyramid-shaped lock portion 6*h* which protrudes outwardly. The upper surface 6*i* of this lock portion 6*h* is formed as a surface inclined by a predetermined angle α with respect to a plane orthogonal to the axis of the movable member housing. That is, the upper surface 6*i* of the lock portion 6*h* makes an acute angle with respect to the inner wall of the small diameter cylindrical portion 1*b*.

Further, the joint base 6*a* and the joint cover 6*b* are joined together by an appropriate means such as snap-in engagement to form an integral unit, with the joint bar 6*c* being accommodated therein.

This inner lead block 6 is accommodated in the accommodating portion 1*g* of the upper rotor member 1. In this state, the lead lines 20 of the inner lead block 6 are led out to the exterior from the opening 1*n*, and a part of the upper end surface of the inner lead block 6 is in contact with the upper wall 1*p* of the accommodating portion 1*g*.

Further, the upper surface of the partition 6*g* and the upper surface of the box-shaped portion 6*e* are substantially flush with the inner wall surface of the small diameter cylindrical portion. Thus, the lock portion 6*h* protrudes from the inner wall surface of the small diameter cylindrical portion toward the central axis of the center hole 1*a*.

Next, the lower rotor member 2 of the rotary connector 10 of the present invention will be described.

As shown in FIG. 7, the lower rotor member 2 is formed of a synthetic resin material, molded, and substantially of a ring-like configuration, and comprises a first cylindrical portion 2*b* having at its center a circular center hole 2*a*, a second cylindrical portion 2*c* connected outwardly (downwardly) to the first cylindrical portion 2*b* and having a diameter larger than that of the first cylindrical portion 2*b*, and a round flange 2*d* outwardly protruding from the upper end portion of the second cylindrical portion 2*c*.

Further, the first cylindrical portion 2*b* is provided with a pair of grooves 2*e* substantially opposed to each other, and a plurality of (e.g., five) rectangular openings 2*f*. Further, the upper inner wall 2*g* of each of, for example, half the plurality of openings 2*f* (e.g., two: every other or every third of them) (See FIG. 3) is formed as a plane inclined by a predetermined inclination angle a with respect to a plane orthogonal to the axis of the movable member housing, and the upper inner wall 2*g* of each of the remaining openings (e.g., three: adjacent ones or every other of them) is formed as a plane orthogonal to the axis of the movable member housing. One of the inner walls 2*g* formed as planes inclined by the predetermined angle a is engaged with the lock portion 6*h* of the inner lead block 6.

The upper inner walls 2*g* of the other openings 2*f* are engaged with the engagement portions of the upper rotor member 1.

Further, the openings 2*f* of the lower rotor member 2 function as a retaining portion locking the lock portion 6*h*.

Further, at the open end of the first cylindrical portion 2*b*, there is formed a substantially annular inclined surface 2*h* having a predetermined inclination angle.

The first cylindrical portion 2*b* of the lower rotor member 2 is inserted into the small diameter cylindrical portion 1*b* of the upper rotor member 1. At this time, the pair of protrusions 1*i* are arranged in the grooves 2*c*, and the inner upper walls 2*g* of the openings 2*f* are in contact with the upper surfaces 1*r* of the engagement portions 1*q*. In this way, the upper rotor member 1 and the lower rotor member 2 are engaged with each other.

That is, the upper surfaces 1*r* of approximately half the engagement portions 1*q* and the inner walls 2*g* of approximately half the opening 2*f* are in contact with each other by planes inclined by an inclination angle a with respect to the axis, and in the remaining engagement portions and openings, the contact is effected by planes orthogonal to the axis. And, the upper surfaces 1*r* of the engagement portion 1*q* and the inner walls 2*g* of the openings 2*f* which are in contact with each other by planes inclined by the inclination angle α with respect to the axis are engaged such that the lower rotor member is prevented from being detached from the upper rotor member and the lead block.

As described above, when the engagement portion 1*q* and the openings 2*f* are in contact with each other by planes inclined by the inclination angle a with respect to the axis, a large clearance for assembly is required due to the inclination angle a when incorporating the lower rotor member 2 into the upper rotor member 1, which, however, involves an increase in play. To minimize this play, approximately half the engagement portions 1*q* and approximately half the openings 2*f* are in contact with each other by planes orthogonal to the axis, so that a small clearance suffices. Thus, by arranging the engagement portions 1*q* and the openings 2*f* at appropriate positions, it is possible to provide a rotary connector with little play. portions 1*h* and the openings 2*f* at appropriate positions, it is possible to provide a rotary connector with little play.

While in the above-described embodiment the engagement portions of the upper rotor member and the openings of the lower rotor member, which are in contact with each other by planes inclined by an inclination angle a with respect to the axis, are provided every other or every third, this should not be construed restrictively. It is also possible to form a rotary connector in which planes (contact surfaces) having the inclination angle a in all the engagement portions and the openings (retaining portions).

Further, while in the above-described embodiment the lead lines are led out from the inner lead block 6, it is also possible for connector pins to be led out from the inner lead block and connected to the associated connector.

As described above, in the rotary connector of the present invention, the engagement portions of the lead block and the retaining portions of the lower rotor member are engaged with each other to join the lead block with the lower rotor member, so that if a strong tensile force is applied to the lead block, the lead block is locked to the lower rotor member, and accommodated in the accommodating portion of the upper rotor member, whereby it is possible to provide a rotary connector strong enough to withstand decomposition.

Further, in the rotary connector of the present invention, the engagement surfaces of the engagement portions of the lead block and the retaining portions of the lower rotor member make an acute angle with respect to the inner wall of the cylindrical portion of the upper rotor member, so that the lead block is reliably locked to the lower rotor member, whereby it is possible to provide a rotary connector strong enough to withstand decomposition.

Further, in the rotary connector of the present invention, the retaining portions are provided on the inner walls of openings provided in the cylindrical portion of the lower rotor member, so that the retaining portions have a configuration which is not complicated but simple, which facilitates the manufacturing process, thereby making it possible to provide an inexpensive rotary connector.

What is claimed is:

1. A rotary connector comprising:

a flexible cable;

a movable housing comprising an upper rotor member and a lower rotor member; and an annular stationary housing coupled to the flexible cable and the movable housing between the upper and lower rotor members;

wherein the lower rotor member comprises a cylindrical portion passing through an aperture bound by inner radial surfaces of the annular stationary housing and the upper rotor member, the lower rotor member having a plurality of recesses passing through an outer surface of the cylindrical portion;

wherein the upper rotor member comprises a lead block comprising an accommodating portion and a lock portion, the accommodating portion supporting a plurality of lead lines that are electrically coupled to the flexible cable;

the lock portion being coupled to the upper rotor member and being configured to project into the aperture and at least one of the recesses passing through the outer surface of the cylindrical portion of the lower rotor member.

2. A rotary connector according the claim 1, wherein the lock portion comprises an upper surface, the upper surface being configured to form an acute angle with a plane orthogonal to a portion of the inner radial surface of the upper rotor member.

3. A rotary connector according to claim 1, wherein the upper rotor member comprises a plurality of engagement portions unitary with the inner radial surface of the upper rotor, wherein the plurality of recesses passing through the outer surface of the cylindrical portion of the lower rotor member are partially bound by upper inner walls and a select number of the upper inner walls are inclined to receive at least one of the upper surface of the lock portion or one of the plurality of engagement portions.

4. A rotary connector according to claim 1, wherein the plurality of recesses passing through the outer surface of the cylindrical portion are partially bound by upper inner walls that form an acute angle with a plane orthogonal to an axis of rotation of the movable housing.

5. A rotary connector according to claim 2, wherein the plurality of recesses passing through the outer surface of the cylindrical portion are partially bound by upper inner walls, wherein about half of the upper inner walls are inclined.

6. A rotary connector according to claim 2, wherein the plurality of recesses passing through the outer surface of the cylindrical portion are partially bound by upper inner walls and a select number of upper inner walls form an acute angle with a plane orthogonal to an axis of rotation of the movable housing.

7. A rotary connector comprising:

a cable;

a movable housing comprising an upper rotor and a lower rotor; and a stationary housing coupled to the cable and to the upper and lower rotors; wherein the lower rotor comprises a hollow cylindrical portion passing through an aperture bound by inner radial surfaces of the stationary housing and the upper rotor member, the lower rotor member having a plurality of recesses passing through an inner and outer radial surface of the hollow cylindrical portion, the recesses being partially bound by upper inner walls;

wherein the upper rotor member comprise a plurality of engagement portions and a lead block, the lead block comprising an accommodating portion and a lock portion, the accommodating portion supporting a plurality of lead lines that are electrically coupled to the cable;

the lock portion being coupled to the lead block and being configured to project into the aperture and at least one of the recesses passing through the inner and outer radial surfaces of the hollow cylindrical portion, the lock portion comprising an upper surface, the upper surface being configured to form an acute angle with a plane orthogonal to a portion of the inner radial surface of the upper rotor member;

wherein a select number of upper inner walls form an acute angle with a plane orthogonal to an axis of rotation of the movable housing and are coupled to one of the plurality of engagement portions that protrude from the inner radial surface of the upper rotor member or the lock portion.

8. A rotary connector according to claim 7 further comprising a steering wheel, wherein said movable housing is coupled to the steering wheel.

* * * * *

UNITED STATES PATENT AND TRADEMARK OFFICE

CERTIFICATE OF CORRECTION

PATENT NO. : 6,390,838 B1
DATED : May 21, 2002
INVENTOR(S) : Kazuya Kawamura

It is certified that error appears in the above-identified patent and that said Letters Patent is hereby corrected as shown below:

Column 10,
Line 14, delete "comprise" and substitute -- comprises -- in its place.

Signed and Sealed this

Seventh Day of October, 2003

JAMES E. ROGAN
*Director of the United States Patent and Trademark Office*